United States Patent [19]

Oguro

[11] 4,143,295

[45] Mar. 6, 1979

[54] CATHODE STRUCTURE FOR AN ELECTRON TUBE

[75] Inventor: Tomokatsu Oguro, Mobara, Japan

[73] Assignee: Hitachi, Ltd., Japan

[21] Appl. No.: 821,338

[22] Filed: Aug. 3, 1977

[30] Foreign Application Priority Data

Aug. 9, 1976 [JP] Japan ..... 51-94016

[51] Int. Cl.[2] ..... H01J 1/14; H01J 19/06; H01K 1/04

[52] U.S. Cl. ..... 313/346 R; 313/337; 313/341

[58] Field of Search ..... 315/39.51; 313/341, 313/337, 338, 346, 344

[56] References Cited

U.S. PATENT DOCUMENTS

| | | | |
|---|---|---|---|
| 2,998,544 | 8/1961 | Crapuchettes | 315/39.51 |
| 3,177,393 | 4/1965 | Gerlach et al. | 313/341 X |
| 3,289,023 | 11/1966 | Adikes et al. | 313/344 X |
| 3,558,970 | 1/1971 | Van De Goor et al. | 313/341 |
| 3,600,334 | 8/1971 | Koncz | 313/346 |

*Primary Examiner*—Saxfield Chatmon, Jr.
*Attorney, Agent, or Firm*—Craig & Antonelli

[57] ABSTRACT

A cathode structure for an electron tube comprises a filament unit and a supporter on which the filament unit is mounted. The filament unit includes a thoriated tungsten wire and a tungsten carbide layer formed by carburizing the surface of the wire, the wire having a diameter of about 0.6 – 0.8 mm and the carbide layer having a thickness of about 5 – 30 μ, so that the resulting cathode structure enjoys a long life.

2 Claims, 4 Drawing Figures

CATHODE STRUCTURE FOR AN ELECTRON TUBE

LIST OF PRIOR ART REFERENCES (37 CFR 1.56 (a))

The following references are cited to show the state of the art:

(a) BRITISH JOURNAL OF APPLIED PHYSICS, Vol. 10, January 1959, pp. 10–15

(b) NATIONAL TECHNICAL REPORT, Vol. 16, 10.1 February 1970, pp. 83–96

(c) Japanese journal "HINSHITSU KANRI" (or Quality Control) Vol. 25, No. 7, July 1974, pp. 14–19

The present invention relates to a cathode structure for electron tubes and in particular to a filament unit of the cathode for the electron tubes.

In general, electron tubes such as magnetrons are capable of producing microwaves with a high efficiency and have been employed widely in many applications, including an electronic range or the like for defreezing, heating or the like processing of edible articles. Under the circumstances, there is a great and pressing demand for an improved cathode structure for such electron tubes which can enjoy a long useful life, a high quality of operation and a high reliability.

An object of the invention is to provide a cathode structure for an electron tube which can well withstand repeated on-off operations and thus have a long lifetime.

Figure 1A:
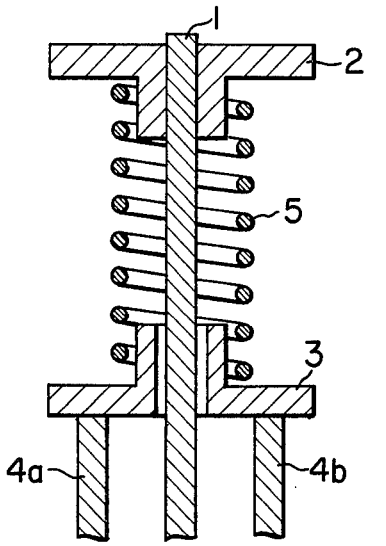
FIG. 1a PRIOR ART
Figure 1B:
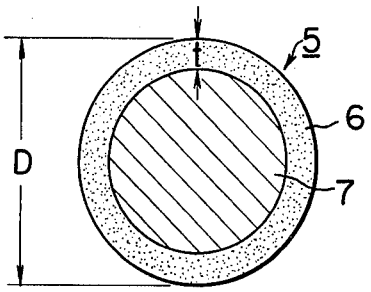
FIG. 1b PRIOR ART
Figure 2:
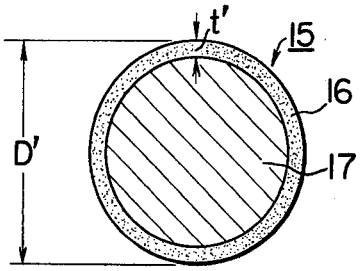
Figure 3:
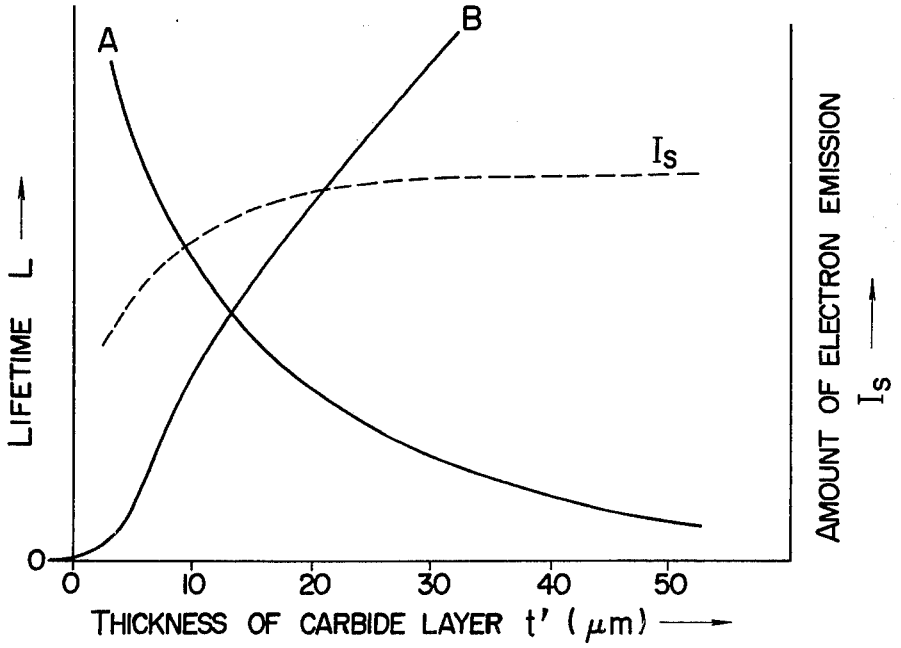

The above and other objects, novel features and advantages of the invention will become more apparent from the detailed description of preferred embodiments of the invention taken in conjunction with the accompanying drawings, in which:

FIG. 1*a* is a sectional view showing the main portion of a hitherto known cathode structure of a conventional magnetron;

FIG. 1*b* is a cross-sectional view showing a filament unit employed in the cathode structure shown in FIG. 1*a*;

FIG. 2 is a cross-sectional view showing a filament unit employed in a cathode structure for an electron tube according to an embodiment of the invention;

FIG. 3 graphycally illustrates characteristics of the cathode structure for an electron tube.

For a better understanding of the invention, description will first be made on a higherto known cathode structure for a conventional electron tube by referring to FIGS. 1*a* and 1*b*. The illustrated magnetron cathode structure comprises a filament unit 5 and a support for mounting the filament unit 5 thereon. The support includes a bar-like central supporting member 1 made of a suitable metal material having a high melting point, a flanged upper end shield 2 which is formed of a metallic material having a high melting point and fixedly secured to a top portion of the supporting member 1 by welding, brazing or the like method and a flanged lower end shield 3 which is formed of the same material as that of the upper end shield 2 and disposed in opposition to the upper end shield 2 and spaced therefrom by a predetermined distance. The lower end shield 3 has bar-like side supporting members 4*a* and 4*b* which are fixedly secured to the bottom surface of the shield 3 in opposition to the central supporting member 1 by brazing or the like. These members 4*a* and 4*b* are also formed of a metal having a high melting point. The central supporting member 1 as well as the side supporting members 4*a* and 4*b* serve also as electric lead conductors for supplying electric current to the filament unit 5 which is spirally formed and disposed around the central supporting member 1 between the opposite surfaces of the shields 2 and 3 with both ends being fixedly secured to the shields 2 and 3, respectively, by brazing. As is shown in FIG. 1*b*, the filament unit 5 is composed of a thoriated tungsten wire 7 having a diameter of about 0.6 mm and a tungsten carbide ($W_2C$) layer 6 covering the whole surface of the thoriated tungsten wire 7. This carbide layer 6 is formed by heating the tungsten wire 7 in an atmosphere containing a hydrocarbon to carburize the surface of the wire. In this connection the ratio t/D of thickness t of the carbide layer 6 to the diameter D of the wire 7 is generally selected in the range of 0.05 to 0.15. (An example of such a filament unit is described in, for example, BRITISH JOURNAL OF APPLIED PHYSICS Vol. 10, January 1959, pp. 10–15.)

With the above described arrangement of the magnetron cathode structure, current supply to the filament unit 5 through the central supporting member 1 and the side supporting members 4*a* and 4*b* will cause the filament unit 5 to be heated, whereby thermions are emitted. The thermion flow is thus produced in the interaction space defined in gaps between the cathode filament unit 5 and anode vanes (not shown) to bring about an oscillation phenomenon.

When the magnetron cathode structure of such an arrangement as described above is to be installed in a microwave oven or the like to heat or defreeze frozen edible articles, the microwave output of the magnetron has to be controlled in dependence on the kind of edible articles as well as the desired cooking pattern. To this end, the cathode filament unit 5 is intermittently supplied with a large operating current for several times or many times for cooking the edibles. For example, when frozen edibles are to be thawed, the current supply is repeated in alternate on-off sequences with on and off durations in a period time being selectively controlled in the range of 5–100%. Thus, in the long run, the number of such intermittent current supply sequences will amount to 100,000 to 150,000. Since the cathode filament unit 5 is subjected to expansion and contraction in the direction of the diameter D every time the current is supplied and interrupted, progressive formation of cracks takes place in the carbide layer 6 of the filament unit 5 due to the accompanying thermal stress, with a result that the lifetime of the filament unit 5 is reduced. Furthermore, because the carbide layer formed in the surface portion of the wire 7 has an extremely low thermal conductivity, there will arise a great difference in temperature between the interior and exterior portions of the carbide layer 6, which, in combination with a difference in the thermal expansion coefficient between the thoriated tungsten wire 7 and the carbide layer 6, will give rise to generation of thermal stress, and thereby injure the carbide layer 6 and reduce the number of emitted thermions. Besides, the carbide layer 6 which is inherently of a relatively fragile nature would be easily injured under externally applied mechanical vibrations and shocks.

FIG. 2 shows in a cross-sectional view a cathode structure for an electron tube and in particular the main portion of a cathode structure according to an embodiment of the invention. The construction of the support for the filament unit as well as the mounting arrangement thereof may be realized in the same manner as shown in FIG. 1*a*. According to the teachings of the invention, a tungsten wire 17 which contains 0.5 to 2% of thorium and has a diameter D' of about 0.6 to 0.8 mm is provided at its surface portion with a carbide ($W_2C$) layer 16 having a thickness t' in the range of about 5 to 30 μm, thereby to constitute a cathode filament unit 15 of a diameter D'. In more particular, the thickness t' of the carbide layer is so selected that the ratio t'/D' is not greater than 0.05. For the formation of the carbide layer 16, the thoriated tungsten wire 17 is previously heated to be cleaned at about 2000° C. in an evacuated atmosphere so as to protect the wire 17 from oxidation. Subsequently, a gas glow containing a large amount of carbon such as propane or methane is fed to the heated tungsten wire 17 to carburize the surface portion of the wire 17, thereby to form the carbide layer over the whole surface of the wire. This carburizing operation is for suppressing evaporation of thorium to prevent deterioration of the electron emission power due to high temperature heating thereby to allow the lifetime of the cathode structure with the filament unit to be lengthened.

In experiments using the filament units 15 of the structure described above where the diameters D' of thoriated tungsten wires are 0.6–0.8 mm, there have been obtained characteristic curves representing the lifetime L and the amount of electron emission $I_s$ as a function of the thickness t' of the carbide layer 16 such as shown in FIG. 3. As can be seen from this figure, when the carbide layer 16 is formed extremely thin with the thickness t' thereof being much less than 5 μm, the carbide layer 16 becomes very much less susceptible to injury such as the cracks produced under the thermal stress due to the repeated on-off operations in an electronic range used for thawing frozen foods, for example; and further, the carbide layer exhibits a significantly enhanced mechanical strength to vibrations and shocks. Thus, the lifetime A under intermittent current supply use is significantly lengthened. However, as the carbide layer 16 is aged to become a finely divided layer structure as accompanied with decrease in the amount of thermion emission, the lifetime B under continuous current supply use of the cathode filament unit 15 itself becomes extremely short, as a result of which the whole lifetime L of the filament unit 15 will be correspondingly shortened. On the other hand, when the carbide layer 16 is formed thick with the thickness t' thereof being much greater than 30 μm, the lifetime B of the cathode filament unit is significantly lengthened with the thermionic emission $I_s$ being maintained substantially constant. However, in the latter case, the thermal stress produced during the intermittent current supply use such as during thawing operations becomes remarkably great, resulting in injuries to the carbide layer 16 which is also inherently very fragile to the mechanical vibrations and shocks, as is in the case of the hitherto known filament unit 5. Thus, the lifetime A under intermittent current supply use is remarkably shortened, resulting in reduction in the whole lifetime L of the filament unit. In other words, it has been discovered that the lifetime A under intermittent current supply use and the lifetime B under continuous current supply use of the filament unit 15 are contrary to each other in respect of the thickness of the carbide layer 16. Starting from this fact, the invention teaches that the thickness t' of the tungsten carbide layer 16 constituting the surface portion of the thoriated tungsten wire 17 having a diameter of about 0.6–0.8 mm should be in the range of about 5 to 30 μm for practical applications, preferably in the range of 5–25 μm and at most preferably 10–20 μm. When the carbide layer 16 is formed to such a thickness, both the lifetime A under intermittent current supply use and the lifetime B under continuous current supply use become fairly good with the thermionic emission being maintained within an acceptable range. Thus, the possibility of the carbide layer 16 being injured under the effect of thermal stress produced during the intermittent current supply use can be significantly reduced in addition to the enhanced strength of the carbide layer against the mechanical vibrations and shocks, thereby to contribute to lengthening the whole lifetime of the filament unit 15.

In the foregoing description, it has been assumed that the carbide layer having a thickness as specified above is applied to the cathode filament unit of a magnetron. However, it will be appreciated that the invention is never restricted thereto but may be effectively applied to cathode filament units for power electron tubes for transmitters or the like.

As will be appreciated from the foregoing, the filament unit according to the invention has not only an extremely enhanced strength against the thermal stress produced during interrupted operation but also exhibits a great mechanical strength against vibrations and shocks. In reality, it has been found that the whole lifetime L of the inventive cathode structure is lengthened to about three times as long as that of the conventional cathode structures.

I claim:

1. A cathode structure for an electron tube comprising a filament unit and support means for supporting said filament unit, said filament unit including a thoriated tungsten wire having a tungsten carbide layer constituting a surface portion of said wire, the thickness of said carbide layer being almost uniform about the axis of said wire, in which the thickness of said tungsten cabide layer is about 5–30 μ and the diameter of said wire including said carbide layer is about 0.6–0.8 mm.

2. A cathode structure according to claim 1, in which said wire includes about 0.5–2% of thorium.

* * * * *